US006637316B2

(12) United States Patent
Engelke et al.

(10) Patent No.: US 6,637,316 B2
(45) Date of Patent: Oct. 28, 2003

(54) PRESSURE FLUID CYLINDER WITH OPTIONAL ANTI-ROTATION FEATURE

(75) Inventors: Heinz-Jürgen Engelke, Hannover (DE); Norbert Fortmann, Hannover (DE); Thomas Liesenhoff, Hannover (DE); Jens Müller, Lilienthal (DE)

(73) Assignee: Rexroth Mecman GmbH, Hannover (DE)

( * ) Notice: Subject to any disclaimer, the term of this patent is extended or adjusted under 35 U.S.C. 154(b) by 0 days.

(21) Appl. No.: 10/131,514

(22) Filed: Apr. 24, 2002

(65) Prior Publication Data

US 2002/0162447 A1 Nov. 7, 2002

(30) Foreign Application Priority Data

Apr. 24, 2001 (DE) ..... 101 20 026

(51) Int. Cl.[7] ..... F15B 15/19
(52) U.S. Cl. ..... 92/165 PR; 92/177; 92/255
(58) Field of Search ..... 92/177, 165 PR, 92/255, 256

(56) References Cited

U.S. PATENT DOCUMENTS 3,180,236 A * 12/1962 Beckett ..... 92/177
4,973,027 A * 11/1990 Casas ..... 92/177
5,279,371 A * 1/1994 Ekwall et al. ..... 92/177
5,562,393 A * 10/1996 Focke et al. ..... 414/626
5,609,091 A * 3/1997 Stoll ..... 92/177
6,152,015 A * 11/2000 Migliori ..... 92/177

FOREIGN PATENT DOCUMENTS

DE 24 31 706 1/1976
JP 56010804 A * 2/1981 ..... F15B/15/14
JP 56024203 A * 3/1981 ..... F15B/15/14

* cited by examiner

*Primary Examiner*—Edward K. Look
*Assistant Examiner*—Thomas E. Lazo
(74) *Attorney, Agent, or Firm*—Henry M. Feiereisen

(57) ABSTRACT

A pressure fluid cylinder with anti-rotation feature, includes a cylinder tube of non-circular inner cross section and a piston which is sealingly received in the tube. The piston has a circular cross section and is connected at one end to a piston rod in coaxial relationship. In order to allow selective use of the pressure fluid cylinder with or without anti-rotation feature, an annular adapter is placed between the piston and the tube and has a circular inner surface area to complement a circular outer surface area of the piston so as to allow a relative rotation between the piston and the adapter. The adapter has a non-circular outer surface area to complement the non-circular inner surface area of the tube. Through insertion of a fastener in aligned boreholes of the adapter and the piston, the adapter and the piston are prevented from rotating relative to one another.

22 Claims, 2 Drawing Sheets

PRESSURE FLUID CYLINDER WITH OPTIONAL ANTI-ROTATION FEATURE

CROSS-REFERENCES TO RELATED APPLICATIONS

This application claims the priority of German Patent Application Serial No. 101 20 026.9, filed Apr. 24, 2001, pursuant to 35 U.S.C. 119(a)–(d), the subject matter of which is incorporated herein by reference.

BACKGROUND OF THE INVENTION

The present invention relates, in general, to a pressure fluid cylinder, and more particularly to a pressure fluid cylinder of a type having a cylinder tube of non-circular inner cross section and a piston received in the tube and having one end connected to a piston rod in coaxial relationship.

Pressure fluid cylinders of this type have been widely used, in particular in automation systems, in order to produce a linear adjustment force through application of a fluid pressure upon the piston, whereby the pressure fluid may be a hydraulic liquid or compressed air.

German Pat. No. DE 24 31 706 A1 discloses a pressure fluid cylinder with a cylinder tube which has a polygonal inner cross section for interaction with a complementary piston so as to provide an anti-rotation structure for a piston rod connected to the piston. The polygonal configuration thus prevents the piston rod from rotating, when the piston rod is acted upon by a moment.

It is also known to attain an anti-rotation structure by designing the piston rod with a non-circular cross section, whereby the piston rod interacts via a suitable sealing arrangement with a complementary opening in the cylinder lid of the pressure fluid cylinder to prevent rotation. The cylinder tube as well as the inner piston can then have a conventional circular configuration, while the piston rod has normally a polygonal or elliptic cross section.

Another conventional approach involves the provision of two piston rods of circular cross section which are secured to the piston in parallel spaced-apart relationship and guided through respective openings in the cylinder lid, to realize an anti-rotation structure. Also in this case, the cylinder tube as well as the inner piston can have a circular cross section.

Manufacturers oftentimes market pressure fluid cylinders in a version with anti-rotation feature and in a version without anti-rotation feature to suit customer's demands. To make both these versions commercially available, version-specific components are needed. Typically, both the cylinder tube and the complementary piston have a non-circular configuration in the pressure fluid cylinder version with anti-rotation feature, while the pressure fluid cylinder version without anti-rotation feature has both the cylinder tube and the complementary piston with circular configuration. Keeping separate constructions is cost-intensive, also when taking into account that sealing elements and other components must be tailored as well for use in either of these versions.

It would therefore be desirable and advantageous to provide an improved pressure fluid cylinder which obviates prior art shortcomings and which is constructed to keep the number of components to a minimum while useable with or without integrated an anti-rotation feature.

SUMMARY OF THE INVENTION

According to one aspect of the present invention, a pressure fluid cylinder includes a cylinder tube with non-circular inner cross section, a piston sealingly received in the tube and having a circular cross section, a piston rod connected in coaxial relationship to one end of the piston, an annular adapter connected to the piston in surrounding relationship and having a circular inner surface area to complement a circular outer surface area of the piston so as to permit a relative rotation between the piston and the adapter, said adapter having a non-circular outer surface area to complement the non-circular inner cross section of the tube, and a fastening unit provided to realize a locked engagement of the adapter to the piston.

The present invention resolves prior art problems by disposing an annular adapter between the piston and the cylinder tube, wherein the adapter has a circular inner surface area in correspondence with the circular cross section of the piston, and a non-circular outer surface area in correspondence to the non-circular inner wall surface of the cylinder tube. In this way, a same pressure fluid cylinder can be configured with or without anti-rotation feature and can be offered commercially as a kit to satisfy both versions if need be. A conversion of the pressure fluid cylinder from the version without anti-rotation feature to the other version with anti-rotation feature can be realized by simply securing the adapter to the piston by means of the fastening unit so to prevent a relative movement therebetween and as a consequence of the complementary non-circular inner configuration of the cylinder tube and the adapter, whereby the adapter is firmly seated on the piston. To reverse the anti-rotation feature and thus to convert the pressure fluid cylinder to the version without anti-rotation feature, the fastening unit is simply removed. As a result, the number of individual components is significantly reduced, while still making available both versions.

According to another feature of the present invention, the fastening unit includes at least one pin insertable in aligned radial boreholes in the piston and the adapter to prevent a relative rotation between the piston and the adapter. The provision of two pins is, however, currently preferred, whereby one pin is insertable in aligned radial boreholes in the piston and the adapter at one location, and the other pin is insertable in aligned radial boreholes in the piston and the adapter at another location which is spaced from the one location. This configuration establishes an optimal compromise between integrity of the anti-rotation feature with regard to a moment acting on the piston rod, on the one hand, and the intent to keep the number of components to a minimum, on the other hand.

As an alternative, the fastening unit may be implemented by a screw, e.g. a set screw, for threaded engagement in a threaded bore of the piston to clamp the adapter. The threaded bore may also be provided in analogous manner in the adapter. Of course, any other configurations or fastening units that are appropriate and known to the artisan to establish a form-fitting or forced engagement may be applicable as well, without departing from the spirit of the present invention.

According to another feature of the present invention, the piston may have a groove-shaped outer radial recess for so receiving the adapter in a form-fitting manner as to allow relative rotation between the piston and the adapter. The form-fitting connection of both components is easy to make and results in a desired rotatablity of the adapter, while effectively inhibiting a relative axial movement. Suitably, the adapter is made of two shells to facilitate the installation of the adapter into the recess, whereby the partition line between the shells is provided in the area of the recess. As an alternative, the adapter may also be composed of two parts.

The adapter may be made of plastic and fabricated through an injection molding process. During fabrication, at least one permanent magnet can be embedded in the adapter to monitor the piston position in conjunction with an inductive sensor placed externally on the cylinder tube. There may also be provided at least one fastening tab, formed externally on the tube and extending in parallel relationship to the cylinder axis, for detachably securing such a sensor or a valve for supply of fluid to the pressure fluid cylinder. A tab-like configuration of the attachment is beneficial compared to a grooved configuration because contaminants cannot deposit as easily. This benefit is in particular of relevance, when a pressure fluid cylinder according to the present invention is used in the food industry which has to observe stringent hygienic regulations.

According to another feature of the present invention, there is provided at least one sealing element which has a substantially ring-shaped configuration and is disposed in a space between the piston and an inner wall of the tube. The sealing element is hereby so held in the space upon the piston to allow rotation thereto, and interacts with the inner wall of the tube for dynamically sealing the inner wall so as to have an outer contour which matches the non-circular cross section. On the inside, the sealing element has a circular configuration to allow a rotation relative to the piston. Currently preferred is an arrangement of exactly two ring-shaped sealing elements on the piston in axially spaced-apart relationship so as to embrace the adapter, wherein the sealing elements form together a double-sided lip seal. This arrangement is especially compact, and the double-sided lip seal attains superior dynamic sealing properties.

According to another feature of the present invention, an annular restraining ring is provided on the piston for realizing a form-fitting securement of the sealing element on the piston while still allowing a relative rotation between these components.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 2:
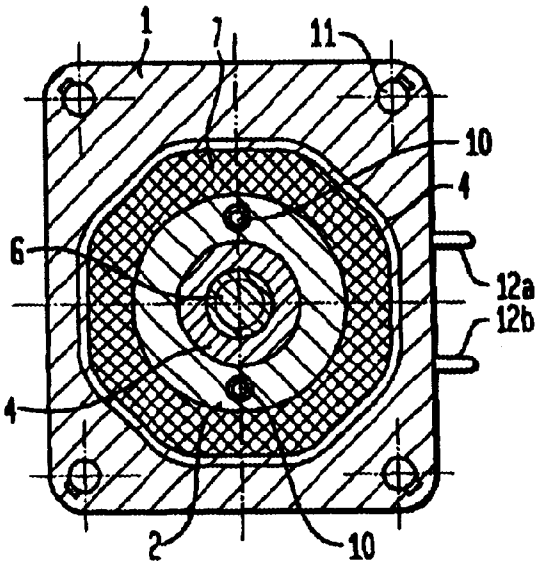
FIG. 2 is a cross sectional view of the pressure fluid cylinder, taken along the line II—II in FIG. 1.

Throughout all the Figures, same or corresponding elements are generally indicated by same reference numerals.

Figure 1:
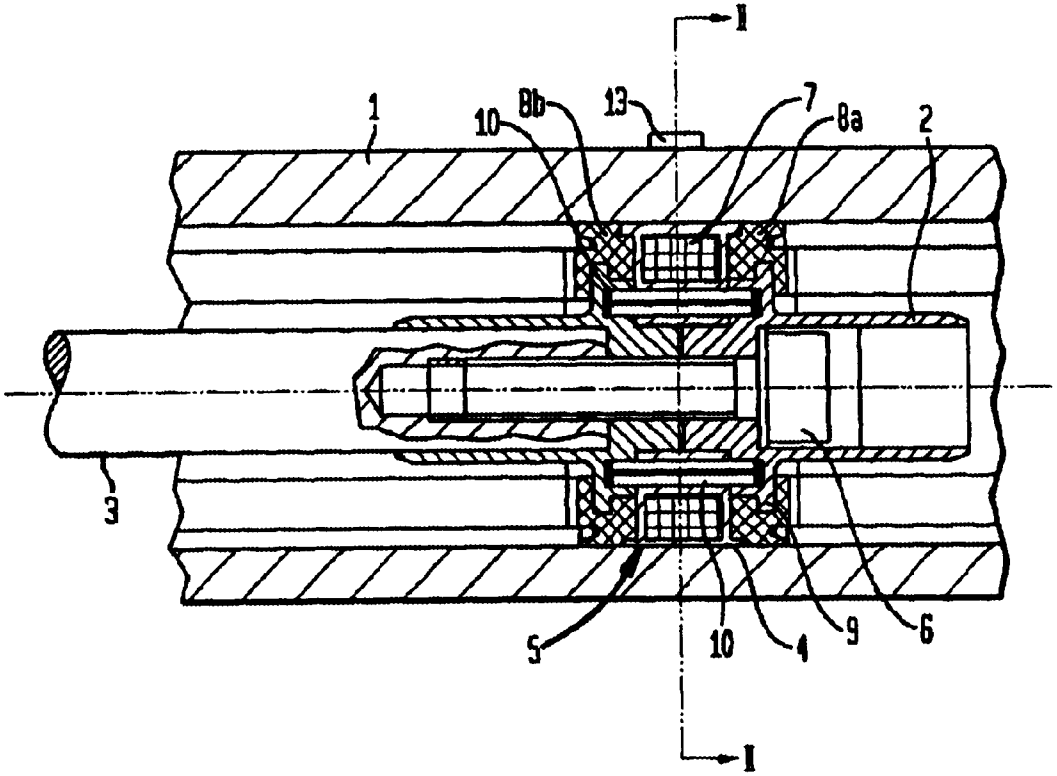
FIG. 1 is a longitudinal section of a first embodiment of a pressure fluid cylinder according to the present invention.

Turning now to the drawing, and in particular to FIG. 1, there is shown a longitudinal section of a pressure fluid cylinder according to the present invention, shown here without cylinder bottom and cylinder lid. The pressure fluid cylinder includes a cylinder tube 1 and a piston 2 received in the tube 1 for movement in a longitudinal direction. The piston 2 has one end extended by a piston rod 3 in coaxial relationship. The tube 1 is made from an extruded hollow section of metal and has a non-circular inner cross section, such as an octagonal inner cross section, as shown by way of example in FIG. 1. Of course, instead of metal, the tube 1 may also be made of a suitable plastic material.

Placed between the tube 1 and the piston 2 is a rotatable ring-shaped adapter 4 which has an outer surface area 5 formed in correspondence with the octagonal inner cross section of the tube 1. The adapter 4 is retained form-fittingly in a groove-shaped outer radial recess of the piston 2 but is able to rotate relative to the piston 2, when the pressure fluid cylinder is intended to operate without anti-rotation feature.

The piston 2 is made of two identical shells and connected by a bolt 6 on one end to the piston rod 3. Embedded in the adapter 4 is a permanent magnet 7, which cooperates with a sensor 13, placed on the outside of the tube 1, for implementing a reliable detection of the position of the piston 2. Disposed in a space between the piston 2 and the inner wall of the tube 1 are two annular sealing elements 8*a,* 8*b* which are secured in spaced-apart relation on the piston 2 in a form-fitting manner by an annular restraining ring 9 while still being able to rotate. The sealing elements 8*a,* 8*b* have sealing lips for abutment against the inner wall of the tube 1 and have a non-circular outer cross section in this area to complement the non-circular inner cross section of the tube 1, ass shown in particular in FIG. 2. Both sealing elements 8*a,* 8*b* form together a double-sided lip seal.

Figure 3:
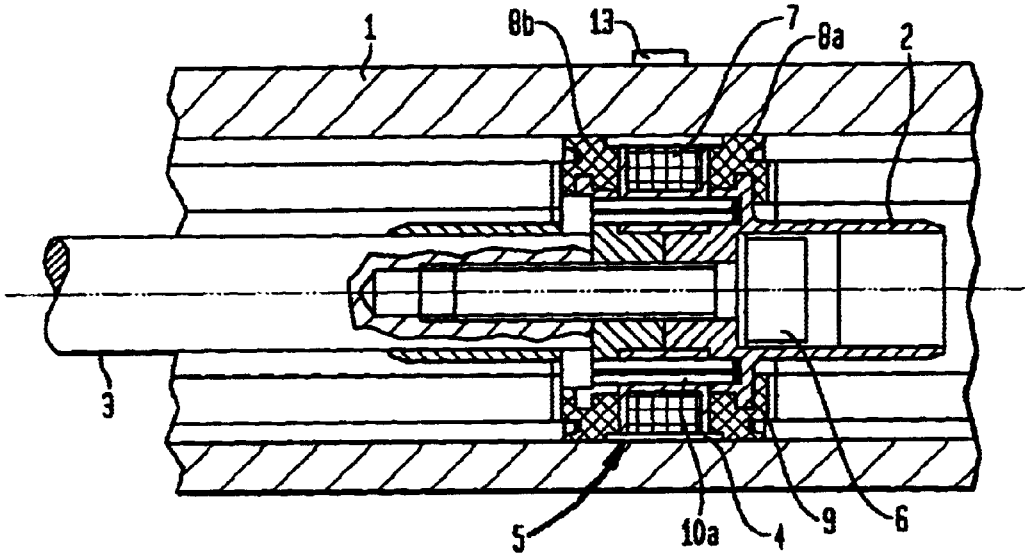
FIG. 3 is a longitudinal section of a second embodiment of a pressure fluid cylinder according to the present invention.

Despite the non-circular inner cross section of the cylinder tube 1, the piston rod 3 is still able to rotate when acted upon by a moment as a consequence of a relative movement between the piston 2 and the adapter 4 placed on the piston 2. In order to convert the pressure fluid cylinder to a version that prevents the afore-mentioned rotation of the piston rod 3 and piston 2, a pin 10 is inserted in aligned radial bores of the piston 2 and the adapter 4. For reasons of achieving an optimal load distribution, the anti-rotation feature is realized by providing precisely two such pins 10*a,* 10*b* which are situated in spaced-apart opposite relationship, as shown in FIG. 2. As an alternative to the provision of pins, the anti-rotation feature may also be realized through the provision of a screw 10*a* for threaded engagement in a complementary threaded bore of the piston 2 to clamp the adapter 4, as shown in FIG. 3 by way of example.

The tube 1 has opposite end faces (only one is shown in FIG. 2) which are each provided with several bores 11 for receiving self-tapping screws, not shown, to attach a, not shown, cylinder bottom and a, not shown, cylinder lid, respectively. The cylinder tube 1 is further provided with two fastening tabs 12*a,* 12*b* formed directly on the outside of the tube 1 in parallel relationship to the longitudinal axis for optional detachable securement of a sensor (such as sensor 13) or a valve or the like. Of course, the fastening tabs 12*a,* 12*b* may also be provided on other sidewalls of the tube 1 and may be used for attachment of the pressure fluid cylinder itself.

While the invention has been illustrated and described as embodied in a pressure fluid cylinder with optional anti-rotation feature, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated. For example, the present invention should not be limited to a double-acting pressure fluid cylinder with one piston rod, as shown in the drawing. Of course, the piston may also be connected on both opposite sides with a piston rod, or to provide the pressure fluid cylinder of single-acting mode.

What is claimed as new and desired to be protected by Letters Patent is set forth in the appended claims and their equivalents:

1. A pressure fluid cylinder with anti-rotation feature, comprising:

a cylinder tube defining an axis and having a non-circular inner cross section;

a piston sealingly received in the tube and having one end, said piston having a circular cross section;

a piston rod connected in coaxial relationship to the one end of the piston;

an annular adapter connected to the piston in surrounding relationship and having a circular inner surface area to complement a circular outer surface area of the piston so as to permit a relative rotation between the piston and the adapter, said adapter having a non-circular outer surface area to complement the non-circular inner cross section of the tube; and fastening means constructed to implement a locked engagement of the adapter to the piston.

2. The pressure fluid cylinder of claim 1, wherein the fastening means includes at least one pin insertable in aligned radial boreholes in the piston and the adapter to prevent a relative rotation between the piston and the adapter.

3. The pressure fluid cylinder of claim 1, wherein the fastening means includes two pins to prevent a relative rotation between the piston and the adapter, one pin insertable in aligned radial boreholes in the piston and the adapter at one location, and the other pin insertable in aligned radial boreholes in the piston and the adapter at another location which is spaced to the one location.

4. The pressure fluid cylinder of claim 1, wherein the locations for the aligned radial boreholes for the pins are arranged on opposite sides.

5. The pressure fluid cylinder of claim 1, wherein the fastening means includes a screw for threaded engagement in a threaded bore of the piston to clamp the adapter.

6. The pressure fluid cylinder of claim 1, wherein the piston has a groove-shaped outer radial recess for so receiving the adapter in a form-fitting manner as to allow a relative rotation between the piston and the adapter.

7. The pressure fluid cylinder of claim 1, and further comprising at least one permanent magnet integrated in the adapter and cooperating with an inductive sensor, placed outside onto the tube, to monitor a piston position.

8. The pressure fluid cylinder of claim 1, and further comprising at least one sealing element having a substantially ring-shaped configuration and disposed in a space between the piston and an inner wall of the tube, wherein the sealing element is held in the space upon the piston so as to allow rotation thereto and interacts with the inner wall of the tube for dynamically sealing the inner wall.

9. The pressure fluid cylinder of claim 1, and further comprising a pair of sealing elements having a substantially ring-shaped configuration and disposed on the piston in axially spaced-apart relationship so as to embrace the adapter, wherein the sealing elements form together a double-sided lip seal for realizing a dynamic seal.

10. The pressure fluid cylinder of claim 8, and further comprising an annular restraining ring, provided on the piston, for realizing a rotatable form-fitting connection of the sealing element on the piston.

11. The pressure fluid cylinder of claim 8, wherein the piston has a circumferential anchoring groove for realizing a rotatable form-fitting connection of the sealing element on the piston.

12. The pressure fluid cylinder of claim 1, wherein the tube is made of an extruded hollow section of plastic or metal.

13. The pressure fluid cylinder of claim 1, and further comprising at least one fastening tab, formed externally on the tube and extending in parallel relationship to the axis, for detachably securing a sensor or valve.

14. The pressure fluid cylinder of claim 1, wherein the tube has opposite end faces, each end face provided with several bores for attachment of a cylinder bottom or a cylinder cover by means of self-tapping screws.

15. The pressure fluid cylinder of claim 1, wherein the adapter is made of plastic through an injection molding process.

16. The pressure fluid cylinder of claim 1, wherein the adapter is made of two parts.

17. A kit for providing a pressure fluid cylinder with optional selection of an anti-rotation feature, comprising:

a cylinder tube having a non-circular inner cross section;

a piston sealingly received in the tube and having a circular cross section;

a piston rod connected to one end of the piston;

an annular adapter disposed between the piston an a confronting inner wall of the tube, said adapter having a circular inner surface area, which complements a circular outer surface area of the piston so as to allow a relative rotation between the piston and the adapter, and a non-circular outer surface area, which complements the non-circular inner cross section of the tube; and fastening means constructed to implement a locked engagement of the adapter to the piston to thereby prevent a relative rotation between the piston and the adapter.

18. The pressure fluid cylinder of claim 17, wherein the fastening means includes a pin insertable in aligned radial boreholes in the piston and the adapter.

19. The pressure fluid cylinder of claim 17, and further comprising a permanent magnet received in the adapter and cooperating with an inductive sensor, placed outside onto the tube, to monitor a position of the piston in the tube.

20. The pressure fluid cylinder of claim 17, and further comprising a sealing element having a substantially ring-shaped configuration and disposed in a space between the piston and an inner wall of the tube, wherein the sealing element is held in the space upon the piston so as to allow rotation thereto and interacts with the inner wall of the tube for dynamically sealing the inner wall.

21. The pressure fluid cylinder of claim 20, wherein the piston is formed with an annular restraining ring for anchoring the sealing element.

22. The pressure fluid cylinder of claim 17, wherein the cylinder tube includes an outwardly projecting fastening tab for detachably securing an additional component.

* * * * *